US007069605B2

(12) United States Patent
Harvey, III

(10) Patent No.: US 7,069,605 B2
(45) Date of Patent: Jul. 4, 2006

(54) CABINET-CRIB COMBINATION APPARATUS

(76) Inventor: Archie Harvey, III, 1190 Woods Rd., Waycross, GA (US) 31501

( * ) Notice: Subject to any disclaimer, the term of this patent is extended or adjusted under 35 U.S.C. 154(b) by 15 days.

(21) Appl. No.: 10/899,331

(22) Filed: Jul. 26, 2004

(65) Prior Publication Data

US 2006/0021135 A1 Feb. 2, 2006

(51) Int. Cl.
*A47D 13/06* (2006.01)
*A47D 11/00* (2006.01)
*A47B 85/00* (2006.01)

(52) U.S. Cl. ..... 5/2.1; 5/93.2

(58) Field of Classification Search ..... 5/2.1, 5/9.1, 93.2, 93.1, 10.1, 112; 312/235.3, 237, 312/313, 315
See application file for complete search history.

(56) References Cited

U.S. PATENT DOCUMENTS

| | | | | | |
|---|---|---|---|---|---|
| 62,974 | A | * | 3/1867 | Sherwood et al. | 109/23 |
| 69,304 | A | | 10/1867 | Bagnall | 5/2.1 |
| 197,122 | A | | 11/1877 | Hale | 5/2.1 |
| 1,391,566 | A | | 9/1921 | Musselman | 5/2.1 |
| 1,516,322 | A | | 11/1924 | Beaucoudray | 5/99.1 |
| 1,644,892 | A | * | 10/1927 | Noble | 296/174 |
| 1,870,719 | A | * | 8/1932 | Fain | 297/43 |
| 1,990,959 | A | | 2/1935 | Saperstein | 5/155 |
| 2,224,727 | A | * | 12/1940 | Friede | 5/9.1 |
| 2,257,625 | A | * | 9/1941 | Thomas | 5/2.1 |
| 2,430,704 | A | | 11/1947 | Brown | 5/99.1 |
| 2,528,307 | A | * | 10/1950 | Heaney | 5/9.1 |
| 2,544,207 | A | * | 3/1951 | Wilson | 5/136 |
| 2,550,599 | A | * | 4/1951 | Reed | 5/9.1 |
| 2,555,776 | A | * | 6/1951 | Alschuler et al. | 5/2.1 |
| 2,622,249 | A | * | 12/1952 | Jones | 5/2.1 |
| 2,634,432 | A | * | 4/1953 | Ehrenberg | 5/94 |
| 2,640,203 | A | | 6/1953 | Sheldon | 5/100 |
| 2,652,572 | A | * | 9/1953 | Hopeman, Jr. et al. | 5/9.1 |
| 2,669,730 | A | * | 2/1954 | Bystrom | 5/2.1 |
| 2,711,544 | A | | 6/1955 | Bystrom | 5/2.1 |
| 2,747,202 | A | * | 5/1956 | Driver | 5/2.1 |
| RE24,457 | E | * | 4/1958 | Hopeman, Jr. et al. | 5/9.1 |
| 2,953,792 | A | * | 9/1960 | Fleischer | 5/9.1 |
| 3,351,961 | A | * | 11/1967 | Daniels et al. | 5/430 |
| 3,402,960 | A | * | 9/1968 | Erke | 296/174 |
| 3,427,666 | A | * | 2/1969 | Saxe | 5/2.1 |
| 3,558,180 | A | * | 1/1971 | Algire | 296/174 |

(Continued)

*Primary Examiner*—Michael Safavi
*Assistant Examiner*—Gay Ann Spahn
(74) *Attorney, Agent, or Firm*—Thomas, Kayden, Horstemeyer & Risley, LLP

(57) ABSTRACT

Disclosed are apparatus for a cabinet-crib combination. In one embodiment, a combination apparatus comprising a housing structure, a crib railing structure, and a mattress tray. The crib railing structure includes a front railing, a left railing, and a right railing. The left and right railings are coupled to the housing structure at a first end of the left and right railing via a swivel. The left and right railings are coupled to the front railing at a second end of the left and right railings via a swivel. The crib railing structure is capable of folding in and out of the housing structure via the swivels. The mattress tray is coupled to the left and right sidewalls of the housing structure via a swivel that allows the tray to fold in and out of the housing structure by pivoting at the left and right sidewalls. When the tray and the crib railing structure are folded out the housing structure, they form a crib. When the tray and the crib railing structure are folded into the housing structure, they are put away into the cabinet.

21 Claims, 3 Drawing Sheets

U.S. PATENT DOCUMENTS

| | | | | | |
|---|---|---|---|---|---|
| 3,722,009 | A | | 3/1973 | Hrynda | 5/93 |
| 3,795,017 | A | | 3/1974 | Saxe | 5/2 |
| 3,811,138 | A | * | 5/1974 | Del Missier | 5/9.1 |
| 4,103,373 | A | | 8/1978 | Luedtke et al. | 5/166.1 |
| 4,318,195 | A | * | 3/1982 | Reppas | 5/2.1 |
| 4,483,027 | A | * | 11/1984 | Cowell et al. | 5/136 |
| 4,633,537 | A | | 1/1987 | Smith | 5/2.1 |
| 4,768,243 | A | | 9/1988 | Waples | 5/100 |
| 4,896,385 | A | * | 1/1990 | Bustos | 5/9.1 |
| 4,918,772 | A | * | 4/1990 | Haile | 5/119 |
| 4,999,865 | A | * | 3/1991 | Sauder et al. | 5/149 |
| 5,353,452 | A | * | 10/1994 | Rulis | 5/136 |
| 5,446,932 | A | * | 9/1995 | Voorhis | 5/137 |
| 6,088,849 | A | * | 7/2000 | Lieber | 5/2.1 |
| 6,339,855 | B1 | | 1/2002 | Socha et al. | 5/93.1 |
| 6,651,275 | B1 | * | 11/2003 | Rummell | 5/99.1 |

* cited by examiner

CABINET-CRIB COMBINATION APPARATUS

TECHNICAL FIELD

The present invention relates generally to convertible household furniture, and more particularly to a cabinet-crib combination apparatus that can fold out to a crib and fold into a cabinet.

BACKGROUND OF THE DISCLOSURE

Typically, a baby crib can consume a lot of space in a room. When the crib is in use, the baby that uses the crib and the parents require space for the crib and baby and space about the crib for tending to the baby. However, when the crib is not in use it is sometimes desirable to replace the crib with another piece of furniture that is more compatible with the room. One solution is to design a baby crib that can be converted into a cabinet. Convertible cribs are disclosed in U.S. Pat. No. 2,544,207 to Wilson, U.S. Pat. No. 2,604,203 to Sheldon, U.S. Pat. No. 2,711,544 to Bystrom, and U.S. Pat. No. 4,633,537 to Smith. However, these combination units do not easily assemble into a crib nor easily convert into a cabinet. Also, it is important that the crib be sturdy so as to safely support a baby, particularly a toddler who has become heavier and stronger. From the above, it can be appreciated that it would be desirable to have a cabinet-crib convertible combination that easily assembles into a crib and converts back into a cabinet and can safely support a child.

SUMMARY OF THE INVENTION

Briefly described, the invention disclosed herein concerns a child's crib that can be expediently converted into a cabinet. The disclosure includes a combination apparatus that has a housing structure, a crib railing structure, and a mattress tray. The crib railing structure includes a front railing, a left railing, and a right railing. The left and right railings are coupled to the housing structure at first ends of the left and right railings via swivels. The left and right railings are coupled to the front railing at second ends of the left and right railings via similar swivels. The crib railing structure is capable of folding in and out of the housing structure. The mattress tray is coupled to the left and right sidewalls of the housing structure via the swivels that allow the tray to fold in and out of the housing structure by pivoting at the left and right sidewalls. When the mattress tray and the crib railing structure are folded out the housing structure, they form a crib. When the tray and the crib railing structure are folded in the housing structure, they are put away into a cabinet.

In a preferred embodiment, the crib railing structure has a front railing, a left railing and a right railing. Each of the left and right railings has a plurality of vertical bars coupled between a top bar and a bottom bar via the swivels that allows the vertical bars to pivot at the top and bottom bars. The left and right railings are coupled to the left and right sidewalls of the housing structure, respectively, at first ends of the left and right railings via the swivels that allow the left and right railings to pivot at the left and right sidewalls. The left and right railings are coupled to ends of the front railing at second ends of the left and right railings via the swivels that allow the left and right railings to pivot at the ends of the front railing. The vertical bars, the top bar, and the bottom bar of the left and right railings form a parallelogram with no right angles when the crib railing structure is in a folded and stored state. Further, the vertical bars of the left and right railings are substantially perpendicular to the top and bottom bars of the left and right railings when the crib railing structure is in a horizontal position.

In a preferred embodiment, the cabinet-crib combination apparatus includes a flap down stay mechanism that is coupled to the housing structure and the crib railing structure. The flap down stay mechanism assists the crib railing structure to fold in and out of the housing structure. The flap down stay mechanism can lock the crib railing structure in a vertical position.

In another embodiment, a convertible crib and storage cabinet assembly includes a cabinet, a rectangular mattress, pivotal support means, and a crib railing structure. The cabinet has opposed parallel side walls and the rectangular mattress tray has opposed end walls and opposed side walls for receiving a mattress therebetween. The pivotal support means tiltably supports the mattress tray to the cabinet between the side walls of the cabinet such that said mattress tray is foldable between a horizontal orientation partially extending from said cabinet to a tilted orientation and received in the cabinet. The crib railing structure includes a front railing and opposed side railings, which each side railing has parallel top and bottom bars and vertical bars extending between the parallel top and bottom bars. Each top and bottom bar of the side railings has a proximal end portion pivotally connected to the side walls of the cabinet and a distal end portion pivotally connected to the front railing such that the crib railing structure can be tilted between a lower horizontal orientation in which the crib railing structure extends outwardly from the cabinet aligned over the end walls and one of the side walls of the mattress tray and an upwardly folded orientation stored within the cabinet, and the front railing maintains in a vertical attitude in both the horizontal orientation and the folded orientation.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENT

Disclosed herein is a convertible crib that can convert from a crib into a cabinet and vice versa. In general, the crib has a crib railing structure and a mattress tray that swings up into the cabinet and down into a crib. The crib railing structure has side railings having vertical bars that fold adjacent to each other when the crib railing structure is inside the cabinet.

Figure 1:
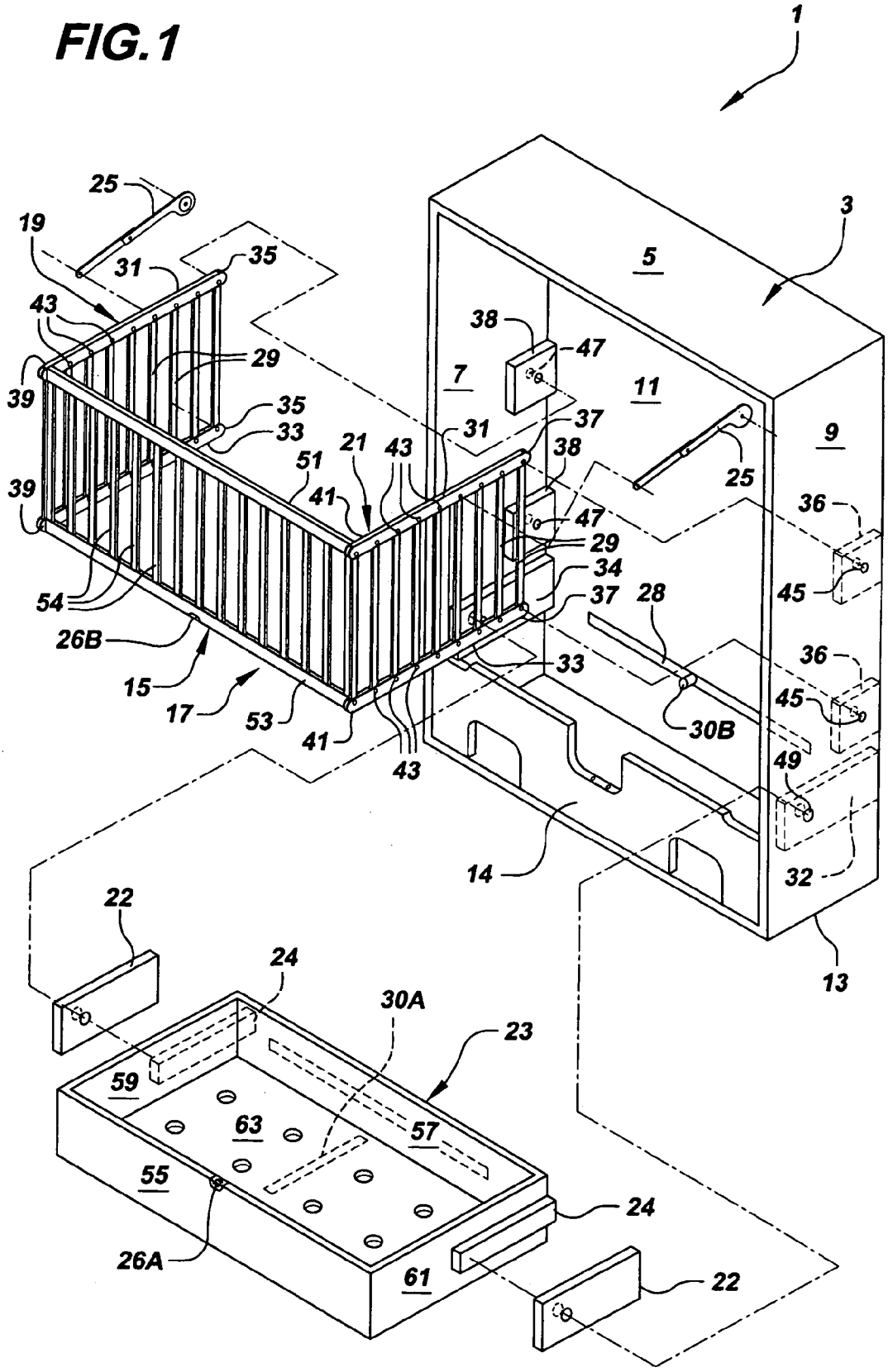
FIG. 1 is an expanded perspective view of an embodiment of a cabinet-crib combination apparatus.

Referring now in more detail to the figures in which like reference numerals identify corresponding parts, FIG. 1 is an expanded perspective view of an embodiment of a cabinet-crib combination apparatus 1 in which the apparatus is not assembled. The convertible cabinet-crib combination apparatus 1 includes a housing structure (or cabinet) 3, a crib railing structure 15, and a mattress tray 23. The housing structure includes a top wall 5, a left sidewall 7, a right sidewall 9, a back wall 11, a bottom wall 13 and a tray support member 14. The sidewalls 7, 9 are preferably opposed parallel walls. The crib railing structure 15 includes a front railing 17, a left railing 19, and a right railing 21. The side railings 19, 21 are preferably opposed to each other. Each of the left and right railings 19, 21 has a plurality of vertical bars 29 that are coupled to a top bar 31 and a bottom bar 33 of the left and right railings 19, 21 via swivels 43. The top bar 31 and the bottom bar 33 are preferably parallel to each other and the vertical bars 29 extend between the parallel top and bottom bars. Each top and bottom bar 31, 33 of the side railings has a proximal end portion pivotally connected to the side walls 7, 9 of the cabinet 3 and a distal end portion pivotally connected to the front railing 17.

The front railing 17 also has a plurality of vertical bars 54 that are connected to a top horizontal bar 51 and a bottom horizontal bar 53 that are mortised into the bars 51, 53 and glued. The front railing 17 is coupled to the left and right railings 19, 21 via the swivels 43 at second ends 39, 41, of the left and right railings 19, 21. The top horizontal bar 51 of the front railing 17 is coupled to the top bars 31 of the left and right railings via the swivels 43. The bottom horizontal bar 53 of the front railing 17 is coupled to the bottom bars 33 of the left and right railings 19, 21 via the swivels 43. The front railing maintains a vertical attitude in both the horizontal orientation and the folded orientation The vertical bars 29, 54 of the front, left, and right railings 17, 19, 21 are typically equally spaced from one another. Fixed upper swivel mounts 36, 38 are each rigidly connected to the left and right sidewalls 7, 9, respectively, of the housing structure 3. The left and right railings 19, 21 are coupled to the left and right fixed upper swivel mounts 36, 38, respectively, of the housing structure 3 via swivels 45, 47 at first ends 35, 37 of the left and right side railings. The swivels 43, 45, 47 allow the left and right railings 19, 21 to fold the crib railing structure 15 in and out of the housing structure 3, which is described in relation to FIGS. 2 and 3.

The mattress tray 23 includes a front wall 55, a back wall 57, a left sidewall 59, a right sidewall 61, and a bottom wall 63. The mattress tray 23 is preferably rectangular and the front and back walls 55, 57 are opposed to each other, as well as the sidewalls 59, 61, for receiving a mattress therebetween. The mattress tray 23 is coupled to the housing structure 3 via a swivel and slide mechanism, which includes a slide member 24, a swivel slide mount 22 and a fixed swivel mounts 32, 34. The mattress tray 23 is connected to the slide members 24, which is connected to swivel slide mounts 22. Fixed lower swivel mounts 34, 32 are each rigidly connected to the left and right sidewalls 7, 9, respectively, of the housing structure 3, preferably below the fixed upper swivel mounts 36 and 38. The mattress tray 23 coupled to the left and right sidewalls 7, 9 of the housing structure 3 via swivels 49, slide members 24, swivel slide mounts 22, and fixed lower swivel mounts 32. The mattress tray 23 is preferably coupled on the housing structure below the crib railing structure 15.

The slide members 24 are connected to the left and right sidewall 59, 61 of the mattress tray 23. The slide members 24 are preferably positioned towards the back wall 57 of the mattress tray 23 so that when the mattress tray 23 is folded out of the housing structure 3 the mattress tray 23 can naturally stay at a horizontal position due to the force of gravity, which is described in FIG. 2. Further, the slide members 24 are preferably positioned toward the bottom wall 63 of the mattress tray 23 so that when the mattress tray 23 is in the vertical position inside the cabinet the mattress tray can naturally stay in the vertical position due to the force of gravity, which is described in FIG. 3. For example, if the mattress tray 23 can have a dimension of three feet by two feet by 7 inches (L×W×H), the swivel 49 can be placed five inches from the back wall 57 and three inches from the bottom wall 63 on the left and right sidewalls 59, 61 of the mattress tray 23.

The slide member 24, swivel slide mount 22 and fixed swivel mounts 32, 34 provide pivotal support means that tiltably supports the mattress tray 23 to the cabinet 3 between the side walls 7, 9 of the cabinet 3 such that the mattress tray 23 is foldable between a horizontal orientation partially extending from the cabinet 3 to a tilted orientation and received in the cabinet 3.

The convertible cabinet-crib combination apparatus 1 further includes a pair of flap down stay mechanism 25 that are each pivotally mounted at one end to the vertical side walls 7, 9 of the housing structure 3 and at the other end of the crib railing structure 15. The flap down stay mechanism 25 can be a modified uni-directional viscous coupling or a mechanical-versus-hydraulic mechanism. The flap down stay mechanism 25 is preferably pivotally coupled to the left and right sidewalls 7, 9 of the housing structure 3 and to the top bars 31 of the left and right railings 19, 21 of the crib railing structure 15. The flap down stay mechanism 25 assists the crib railing structure to fold in and out of the housing structure 3. The mechanism 25 is capable of holding-the crib railing structure 15 in its retracted, stored position when the crib railing structure 15 is inside the housing structure 3. In addition, the mechanism 25 is capable of folding in and out the crib railing structure 15. In a preferred embodiment, a tray lock component 28 is connected to the back wall 11 of the housing structure 3. The tray lock component 28 can be a strip of wood that is glued, screwed or nailed to the back wall 11. A slide bolt 30A is connected to the mattress tray 23. The slide bolt 30A is a friction fit slide bolt that slides into a female component 30B or alternatively, e.g., a hole. The slide bolt 30A is connected to the bottom wall 63 of the mattress tray 23 and the female component 30B is connected on the tray lock component 28. When the mattress tray 23 is in a crib state or horizontal position, the slide bolt 30A engages the female component 30B to prevent the mattress tray 23 from folding inside the housing structure 3, which is further described in FIGS. 2 and 3.

Figure 2:
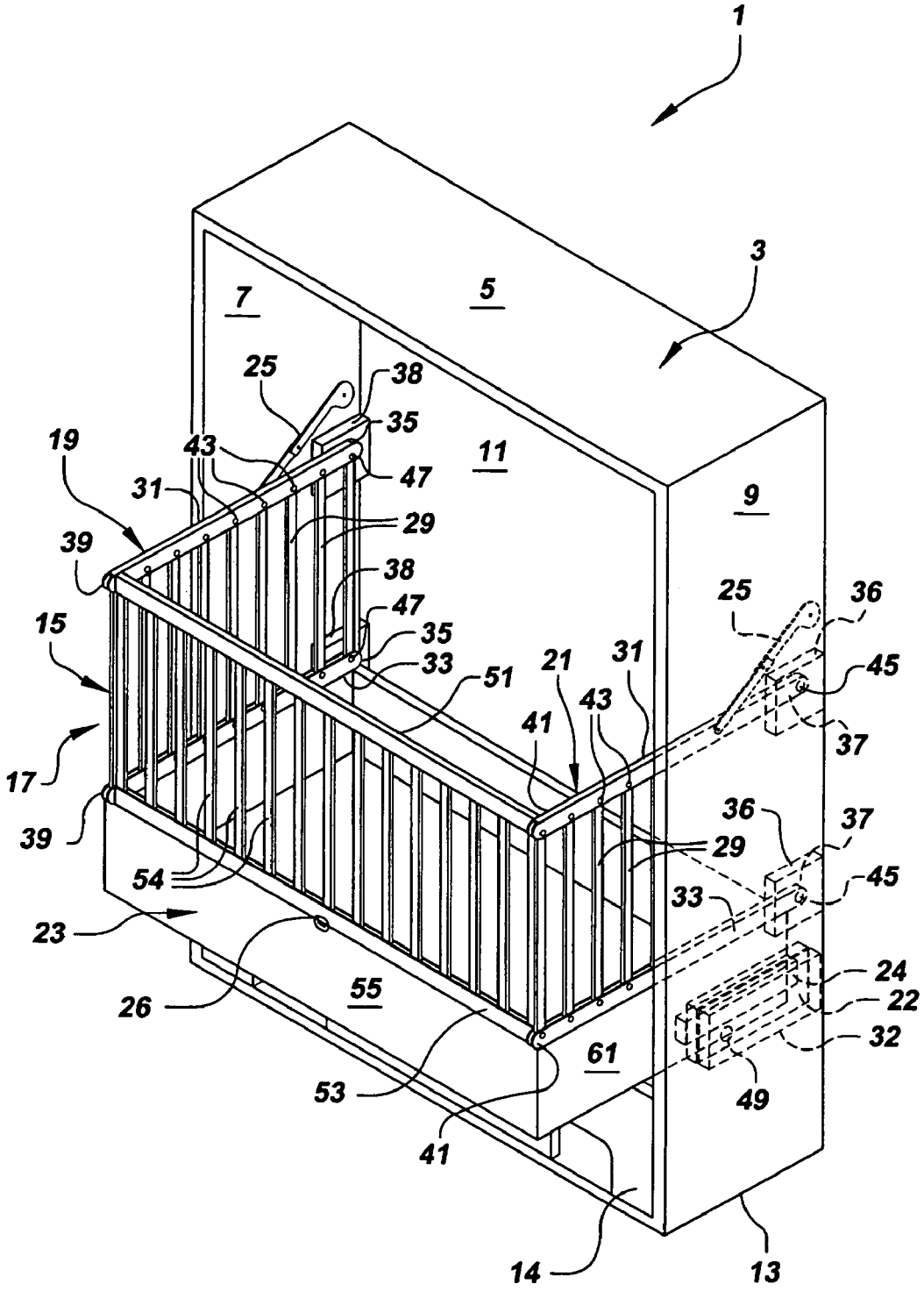
FIG. 2 is a perspective view of the cabinet-crib combination apparatus shown in FIG. 1 in which the crib is folded outside the cabinet.
Figure 3:
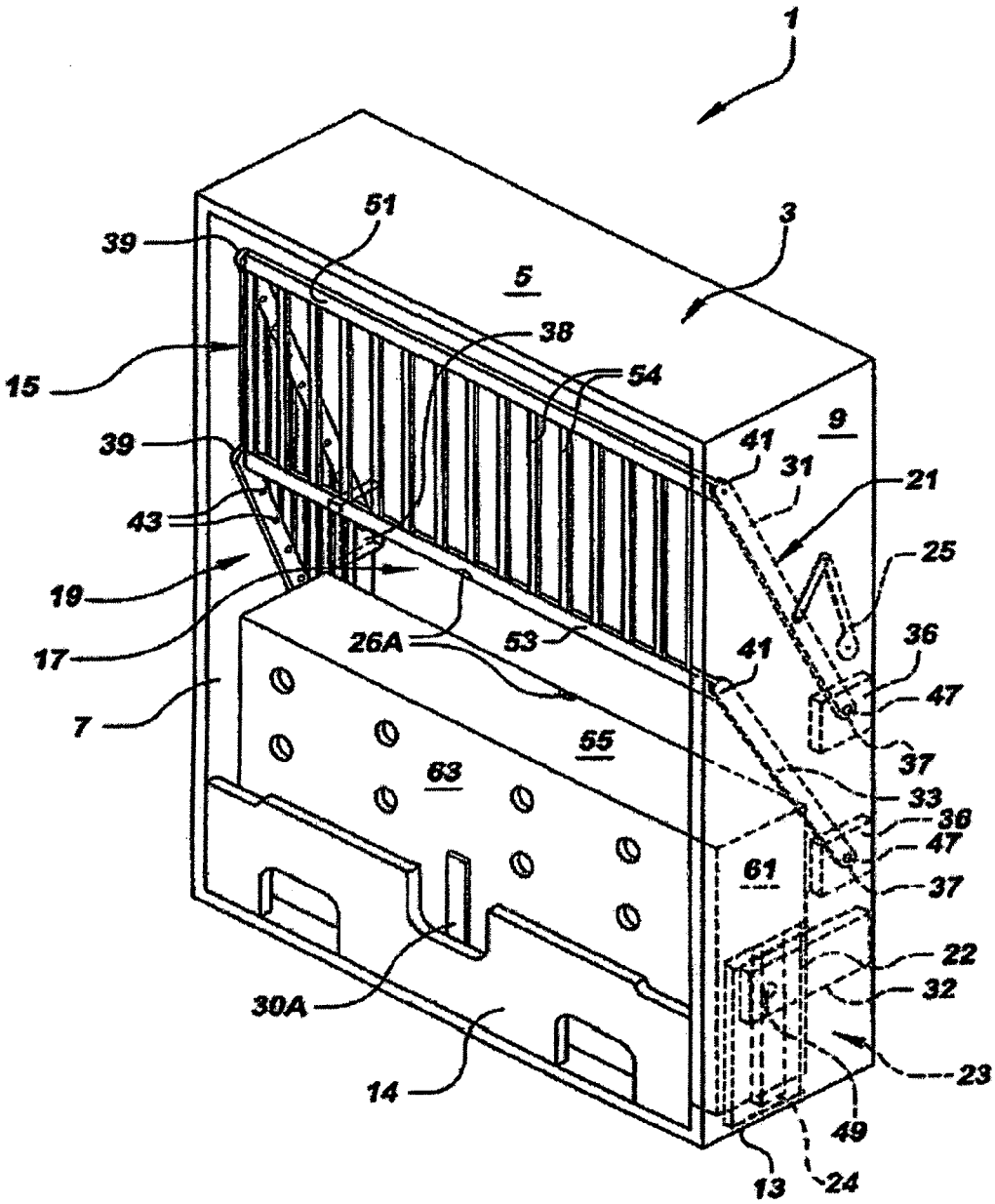
FIG. 3 is a perspective view of a cabinet-crib combination apparatus show in FIG. 1 in which the crib is folded inside of the cabinet.

FIG. 2 is a perspective view of the convertible cabinet-crib combination apparatus that is folded out into a crib state without a mattress. The crib railing structure 15 and the mattress tray 23 tilt to extend out of the housing structure 3 in a horizontal position to form a crib. The crib railing structure 15 swings down and out of the housing structure 3 from a retracted and stored state as shown in FIG. 3 to the crib state. The crib railing structure 15 swings down into the crib state by pivoting from the left and right sidewalls 7, 9 of the housing structure 3.

Because each top and bottom bar 31, 33 of the side railings has a proximal end portion pivotally connected to the side walls 7, 9 of the cabinet 3 and a distal end portion pivotally connected to the front railing 17, the crib railing structure 15 can be tilted a horizontal orientation in which the crib railing structure 15 extends outwardly from the cabinet 3 aligned over the front and back walls 55, 57 and one of the side walls 59, 61 of the mattress tray 23. The crib railing structure 15 is positioned above and adjacent the mattress tray 23. Preferably, the bottom bars 33 of the left and right railing 19, 21 are positioned adjacent and above to the outside edge of the left and right sidewalls 59, 61, respectively, of the mattress tray 23. The front railing 17 is positioned adjacent and directly above the front wall 55 of the mattress tray 23. The top and bottom bars 51, 53 of the front railing 17 are coupled to the top and bottom bars 31, 33, respectively, of the left and right railing 19, 21 via the swivels 43. In the crib state, the top and bottom bars 31, 33 of the left and right railing 19, 21 are a substantially perpendicular to the vertical bars 29.

Preferably, the flap down stay mechanism 25 is extended when the crib railing structure 15 is in a horizontal position as shown in FIGS. 1 and 2 and positioned above the crib railing structure 15. When the crib railing structure 15 swings down into the crib state, the flap down stay mechanism 25 assists the crib railing structure 15 into the crib state.

In the crib state, the mattress tray 23 is in a horizontal position and has been folded out of the housing structure 3. The mattress tray 23 is below and adjacent to the crib railing structure 15. Preferably, the left and right sidewalls 59, 61 of the mattress tray 23 are positioned adjacent and below to the inside of the bottom bars 33 of the left and right railing 19, 21, respectively. The front wall 55 of the mattress tray 23 is positioned adjacent and directly below the front railing 17. The mattress tray 23 is coupled to the left and right sidewalls 7, 9 of the housing structure 3 via swivels and slides 49, slide members 24, swivel slide mount 22 and fixed lower swivel mounts 32, 34. The slide members 24 are preferably positioned towards the back of the mattress tray 23 so that when the mattress tray 23 is folded out of the housing structure 3 the mattress tray 23 can naturally stay at a horizontal position due to the force of gravity.

The slide members 24 guide the mattress tray 23 to slide horizontally out of or partially out of the housing structure 3. Further, because the slide members 24 are positioned toward the back wall 57 of the mattress tray 23 and support the back of the mattress tray and the tray support member 14 is positioned toward the front wall 55 of the mattress tray 23 and supports the front portion of the mattress tray, the mattress tray 23 is supported in a horizontal position in the crib state. The bottom wall 63 of the mattress tray 23 rests on the tray support member 14, which is located below the mattress tray toward the front wall 55 of the mattress tray 23. The left upper edges of the and right side walls 59 and 61 of the mattress tray can engage the bottom bars 33 of the left and right railings 19, 21 when the mattress tray 23 and the crib railing structure 15 are in the horizontal position.

In a preferred embodiment, the crib railing structure 15 and the mattress tray 23 may be connected with a locking mechanism 26A and 26B to prevent the crib railing structure 15 and the mattress tray 23 from folding into the housing structure 3. A part of the locking mechanism 26B is connected to the bottom bar 53 of the front railing 17 and another part 26A is connected to the front wall of the mattress tray 23, and the two parts 26A–B can lock to maintain a crib state.

In a preferred embodiment, a slide bolt (not shown) is connected to the mattress tray 23 and a tray lock member (not shown) is connected to the back wall 11 of the housing structure 3. As described above with reference to FIG. 1, the slide bolt is connected to the bottom wall of the mattress tray 23 and the female component is connected on the tray lock member. The user typically reaches under the mattress tray 23 to slide the slide bolt 30A to engage the female component 30B, which prevents the mattress tray 23 from folding inside the housing structure 3.

To convert the mattress tray 23 from its inclined stored position as shown in FIG. 3 to its horizontal position as shown in FIG. 2, the mattress tray 23 is folded down so that its front portion extends out of the housing structure 3. When the mattress tray is at the horizontal position, the user slides the slide member to engage the bolt member. The components of the locking mechanism 26A and 26B mounted on the mattress tray 23 and the crib railing structure 15 engage each other and lock the mattress tray 23 and the railing structure together.

FIG. 3 is a perspective view of an embodiment of the cabinet-crib combination apparatus shown in FIG. 1 that is in a folded and stored state. The crib railing structure 15 and the mattress tray 23 fold inside the housing structure 3 as separate and individual pieces. From the crib state to the folded state of the crib railing structure 15, the crib railing structure 15 swings up and inside the housing structure 3 by pivoting from the left and right sidewalls 7, 9 of the housing structure 3. When the crib railing structure 15 swings up into the folded state, the flap down stay mechanism 25 slowly assists the crib railing structure 15 into the folded state and locks the structure 15 into the folded state.

In the folded state, the vertical bars 29 of the left and right railings 19, 21 fold adjacent to each other. Further, the vertical bars 29 of the left and right railings 19, 21 are substantially parallel to each other, and the top and bottom bars 31, 33 of the left and right railings 19, 21 are also substantially parallel to each other. The vertical bars 29, the top bar 31, and bottom bar 33 form a parallelogram with no right angles, and the top and bottom bars 51, 53 of the front railing 17 remain substantially perpendicular to the vertical bars 54. The front railing 17 can swing up toward the top wall 5 of the housing structure 3 by the left and right railings 19, 21 and is positioned inside the housing structure 3. This is because the vertical bars 29 and the front railing 17 are pivoted at the top and bottom bars 31, 33 via the swivels 43 such that the vertical bars 29 and front railing 17 fold onto each other or are adjacent to each other when the crib railing structure 15 is in the folded state.

Because each top and bottom bar 31, 33 of the side railings has a proximal end portion pivotally connected to the side walls 7, 9 of the cabinet 3 and a distal end portion pivotally connected to the front railing 17, the crib railing structure 15 can be tilted in an upwardly folded orientation stored within the cabinet 3. The mattress tray 23 folds up into a vertical position inside the housing structure 3 between the left and right railings 17, 19. The slide members 24 are positioned toward the bottom wall 63 of the mattress tray 23 so that when the mattress tray 23 is folded inside the housing structure 3 the mattress tray 23 can naturally tilt toward the back wall 11 of the housing structure 3 at the vertical position due to the force of gravity.

To fold the mattress tray 23 from the horizontal position to the vertical position, the user unlocks the slide bolt mechanism located underneath the mattress tray 23. The mattress tray 23 is then tilted upward from the tray lock mechanism (not shown) and pulled out horizontally away from the housing structure 3 so that the slide bolt mechanism 30 can clear the back wall 11 and the tray lock mechanism 28 when the mattress tray 23 folds up into the vertical position. The mattress tray 23 is then lifted up and folded into the vertical position.

It should be emphasized that the above-described embodiments of the present disclosure, particularly, any "preferred" embodiments, are merely possible examples of implementations, merely set forth for a clear understanding of the principles of the invention. Many variations and modifications may be made to the above-described embodiment(s) of the disclosure without departing substantially from the spirit and principles of the invention. All such modifications and variations are intended to be included herein within the scope of this disclosure and protected by the following claims.

Therefore, having thus described the invention, at least the following is claimed:

1. A cabinet-crib combination apparatus comprising:

a housing structure;

a crib railing structure being capable of swinging up and down and in and out of the housing structure via a first set of swivels and a second set of swivels, the crib railing structure having a front railing, a left railing and a right railing, wherein the left and right railings are coupled to the housing structure at first ends of the left and right railings via the first set of swivels, wherein the left and right railings are coupled to the front railing at second ends of the left and right railing via the the second set of swivels; and a mattress tray being capable of swinging up and down and in and out of the housing structure via a swivel and slide mechanism, the mattress tray being coupled to the left and right sidewalls of the housing structure via a third set of swivels of the swivel and slide mechanism that allow the mattress tray to pivot at left and right sidewalls of the housing structure.

2. The apparatus of claim 1, wherein the housing structure has a top wall, a back wall, and a bottom wall connected to the left and right sidewalls.

3. The apparatus of claim 1, wherein each of the left and right railings has a plurality of vertical bars coupled between a top bar and a bottom bar via the second set of swivels that allow the vertical bars to pivot at the top and bottom bars, the left and right railings being coupled to the left and right sidewalls of the housing structure, respectively, at the first ends of the left and right railings via the first set of swivels that allow the left and right railings to pivot at the left and right sidewalls, the left and right railings being coupled to first and second ends of the front railing at the second ends of the second set of left and right railings via the swivels that allow the left and right railings to pivot at the first and second ends of the front railing.

4. The apparatus of claim 1, further comprising a flap down stay mechanism being connected to the housing structure and the crib railing structure, the flap down stay mechanism being capable of assisting the crib railing structure to fold in and out of the housing structure, the flap down stay mechanism being capable of locking the crib railing structure in a vertical position.

5. The apparatus of claim 1, wherein the swivel and slide mechanism allows the mattress tray to pivot in and out of the housing structure, wherein the swivel and slide mechanism allows the mattress tray to slide down into a locking position when the mattress tray is pivoted into the housing structure, the swivel and slide mechanism comprising a slide member that is coupled to the housing structure via a bolt pivoting member.

6. The apparatus of claim 5, wherein the swivel and slide mechanism further comprises a swivel slide mount and fixed swivel mount, the swivel slide mount is connected to the slide member and the fixed swivel mount is connected to the housing structure, the slide member and the swivel slide mount are coupled to the fixed swivel mount via the bolt pivoting member.

7. The apparatus of claim 3, wherein the vertical bars, the top bar, and the bottom bar of the left and right railings form a parallelogram with no right angles when the crib railing structure is in a folded state.

8. The apparatus of claim 3, wherein the vertical bars of the left and right railings are substantially perpendicular to the top and bottom bars of the left and right railings when the crib railing structure is in a horizontal position.

9. The apparatus of claim 3, wherein the vertical bars pivot closer to each other so as to be substantially adjacent to each other when the crib railing structure is in a folded state.

10. The apparatus of claim 1, further comprising a slide bolt, a female component and a tray lock mechanism, the slide bolt being connected to a bottom wall of the mattress tray and the tray lock mechanism being connected to a back wall of the housing structure, the female component being coupled to the tray lock mechanism, the slide bolt being capable of engaging the female component when the mattress tray is in a crib state or a horizontal position.

11. The apparatus of claim 1, further comprising a locking mechanism that is connected to the front railing of the crib railing structure and a front wall of the mattress tray, wherein the locking mechanism locks when the mattress tray is in a crib state or a horizontal position to prevent the mattress tray from pivoting inside the housing structure.

12. A cabinet-crib combination comprising:

a housing structure;

a crib railing structure having a front railing, a left railing and a right railing, wherein the left and right railings are coupled to the housing structure at first ends of the left and right railings via a first set of swivels and a second set of swivels, wherein the left and right railings are coupled to the front railing at second ends of the left and right railing via the second set of swivels, wherein each of the left and right railings has a plurality of vertical bars coupled between a top bar and a bottom bar via the second set of swivels, the left and right railings being coupled to left and right sidewalls of the housing structure, respectively, at the first ends of the left and right railings via the second set of swivels, wherein the second set of swivels allow the vertical bars to pivot closer to each other so as to be substantially adjacent to each other when the crib railing structure is in a folded state; and a mattress tray being capable of swinging up and down and in and out of the housing structure via a swivel and slide mechanism, the mattress tray being coupled to the left and right sidewalls of the housing structure via a third set of swivels of the swivel and slide mechanism that allow the mattress tray to pivot at the left and right sidewalls of the housing structure.

13. The apparatus of claim 12, further comprising a flap down stay mechanism connected to the housing structure and the crib railing structure, the flap down stay mechanism being capable of assisting the crib railing structure to fold in and out of the housing structure, the flap down stay mechanism being capable of locking the crib railing structure in a vertical position.

14. The apparatus of claim 12, wherein the swivel and slide mechanism allows the mattress tray to pivot in and out of the housing structure, wherein the swivel and slide mechanism allows the mattress tray to slide down into a locking position when the mattress tray is pivoted into the housing structure, the swivel and slide mechanism comprising a slide member that is coupled to the housing structure via a pivoting member.

15. The apparatus of claim 14, wherein the swivel and slide mechanism further comprises a swivel slide mount and a fixed swivel mount, the swivel slide mount is connected to the slide member and the fixed swivel mount is connected to the housing structure, the slide member and the swivel slide mount is coupled to the fixed swivel mount via the pivoting member.

16. The apparatus of claim 12, wherein the vertical bars, the top bar, and the bottom bar of the left and right railings form a parallelogram with no right angles when the crib railing structure is in a folded state.

17. The apparatus of claim 12, wherein the vertical bars of the left and right railings are substantially perpendicular to the top and bottom bars of the left and right railings when the crib railing structure is in a horizontal position.

18. The apparatus of claim 12, further comprising a slide bolt, a female component and a tray lock mechanism, the slide bolt being connected to a bottom wall of the mattress tray and the tray lock mechanism being connected to a back wall of the housing structure, the female component being coupled to the tray lock mechanism, the slide bolt being capable of engaging the female component when the mattress tray is in a crib state or a horizontal position.

19. The apparatus of claim 12, further comprising a locking mechanism that is connected to the front railing of the crib railing structure and a front wall of the mattress tray, wherein the locking mechanism locks when the mattress tray is in a crib state or a horizontal position to prevent the mattress tray from pivoting inside the housing structure.

20. A convertible crib and storage cabinet assembly, comprising:

a cabinet having opposed parallel side walls;

a rectangular mattress tray having opposed end walls and opposed side walls for receiving a mattress therebetween;

pivotal support means pivotably supporting said mattress tray in said cabinet between said side walls of said cabinet such that said mattress tray is pivotable between a horizontal orientation partially extending from said cabinet to a vertical orientation so as to be received in said cabinet; and a crib railing structure including a front railing and opposed side railings;

said side railings each having parallel top and bottom bars and vertical bars extending between said parallel top and bottom bars, each said top and bottom bar of said side railings having a proximal end portion pivotally connected to the side walls of said cabinet and a distal end portion pivotally connected to said front railing such that the crib railing structure can be pivoted between a lower horizontal orientation in which the crib railing structure extends outwardly from said cabinet aligned over the end walls and one of the side walls of said mattress tray and an upwardly folded orientation so as to be stored within the cabinet, and the front railing maintains a vertical attitude in both the horizontal orientation and the folded orientation.

21. A cabinet-crib combination apparatus comprising:

a housing structure having a top wall, a left sidewall, a right sidewall, a back wall, and a bottom wall;

a crib railing structure being capable of swinging up and down and into and out of the housing structure via a first set of swivels and a second set of swivels, the crib railing structure having a front railing, a left railing and a right railing, wherein each of the left and right railings has a plurality of vertical bars coupled between a top bar and a bottom bar via the second set of swivels that allow the vertical bars to pivot at the top and bottom bars, the left and right railings being coupled to the left and right sidewalls of the housing structure, respectively, at first ends of the left and right railings via the swivels that allow the first set of left and right railings to pivot at the left and right sidewalls, the left and right railings being coupled to ends of the front railing at second ends of the left and right railings via the second set of swivels that allow the left and right railings to pivot at the ends of the front railing;

a flap down stay mechanism being connected to the housing structure and the crib railing structure, the flap down stay mechanism being one of a modified unidirectional viscous coupling and a stay of a mechanical versus hydraulic nature, the flap down stay mechanism being capable of assisting the crib railing structure to fold in and out of the housing structure, the flap down stay mechanism being capable of locking the crib railing structure in a vertical position; and a mattress tray being capable of swinging up and down and in and out of the housing structure via a swivel and slide mechanism, the mattress tray being coupled to the left and right sidewalls of the housing structure via a third set of swivels of the swivel and slide mechanism that allows the tray to pivot at the left and right sidewalls.

* * * * *